US006282774B1

(12) United States Patent
Borucinski et al.

(10) Patent No.: US 6,282,774 B1
(45) Date of Patent: Sep. 4, 2001

(54) ELECTROLYSIS APPARATUS AND PROCESS FOR MANUFACTURING SAME

(75) Inventors: Thomas Borucinski, Dortmund; Karl-Heinz Dulle, Olfen; Jürgen Gegner, Dortmund; Martin Wollny, Witten, all of (DE)

(73) Assignee: Krupp Uhde GmbH, Dortmund (DE)

( * ) Notice: Subject to any disclaimer, the term of this patent is extended or adjusted under 35 U.S.C. 154(b) by 0 days.

(21) Appl. No.: 09/284,043

(22) PCT Filed: Aug. 13, 1997

(86) PCT No.: PCT/EP97/04402

§ 371 Date: Jul. 6, 1999

§ 102(e) Date: Jul. 6, 1999

(87) PCT Pub. No.: WO98/15675

PCT Pub. Date: Apr. 16, 1998

(30) Foreign Application Priority Data

Oct. 5, 1996 (DE) ..... 196 41 125

(51) Int. Cl.[7] ..... C25B 9/04; H01S 4/00

(52) U.S. Cl. ..... 29/592.1; 204/257; 204/279

(58) Field of Search ..... 204/279, 255–258, 204/253, 254; 29/592.1

(56) References Cited

U.S. PATENT DOCUMENTS 4,108,752 8/1978 Pohto et al. .
4,519,888 * 5/1985 Akazawa et al. ..... 204/289 X
4,584,080 * 4/1986 Staab et al. ..... 204/255
4,643,818 * 2/1987 Seko et al. ..... 204/255 X
4,657,650 * 4/1987 Vauss et al. ..... 204/253 X
4,664,770 * 5/1987 Schmitt et al. ..... 204/253 X
4,869,800 * 9/1989 Hofmann et al. ..... 204/253

FOREIGN PATENT DOCUMENTS 0172495 2/1986 (EP) .
2135696 9/1984 (GB) .

OTHER PUBLICATIONS

JP 08–074084 (Mar. 19, 1996) (Abstract No. AN 96–206035 only).

* cited by examiner

*Primary Examiner*—Donald R. Valentine
(74) *Attorney, Agent, or Firm*—Rosenman & Colin LLP

(57) ABSTRACT

When applied to an electrolyser for producing halogen gases from aqueous alkali halogenide solution using several plate-like electrolysis cells arranged side by side in a stack whilst electrically connected, each cell being encased in two semi-shells made from electroconductive material with contact strips on the outer side of at least one of the casing's rear walls, the anode and the cathode being separated from one another by a partition, arranged parallel to one another and electrically connected to the rear wall of the respective casing via metal reinforcements, the current-carrying surface should be as large as possible to avoid uneven current distribution. This is achieved by the fact that the metal reinforcements are in the form of solid plates (10) which are flush with the contact strips (7) and whose side edges run up the entire height of the rear wall (3A, 4A) and the anode (8) or cathode (9).

16 Claims, 4 Drawing Sheets

ELECTROLYSIS APPARATUS AND PROCESS FOR MANUFACTURING SAME

Figure 1:
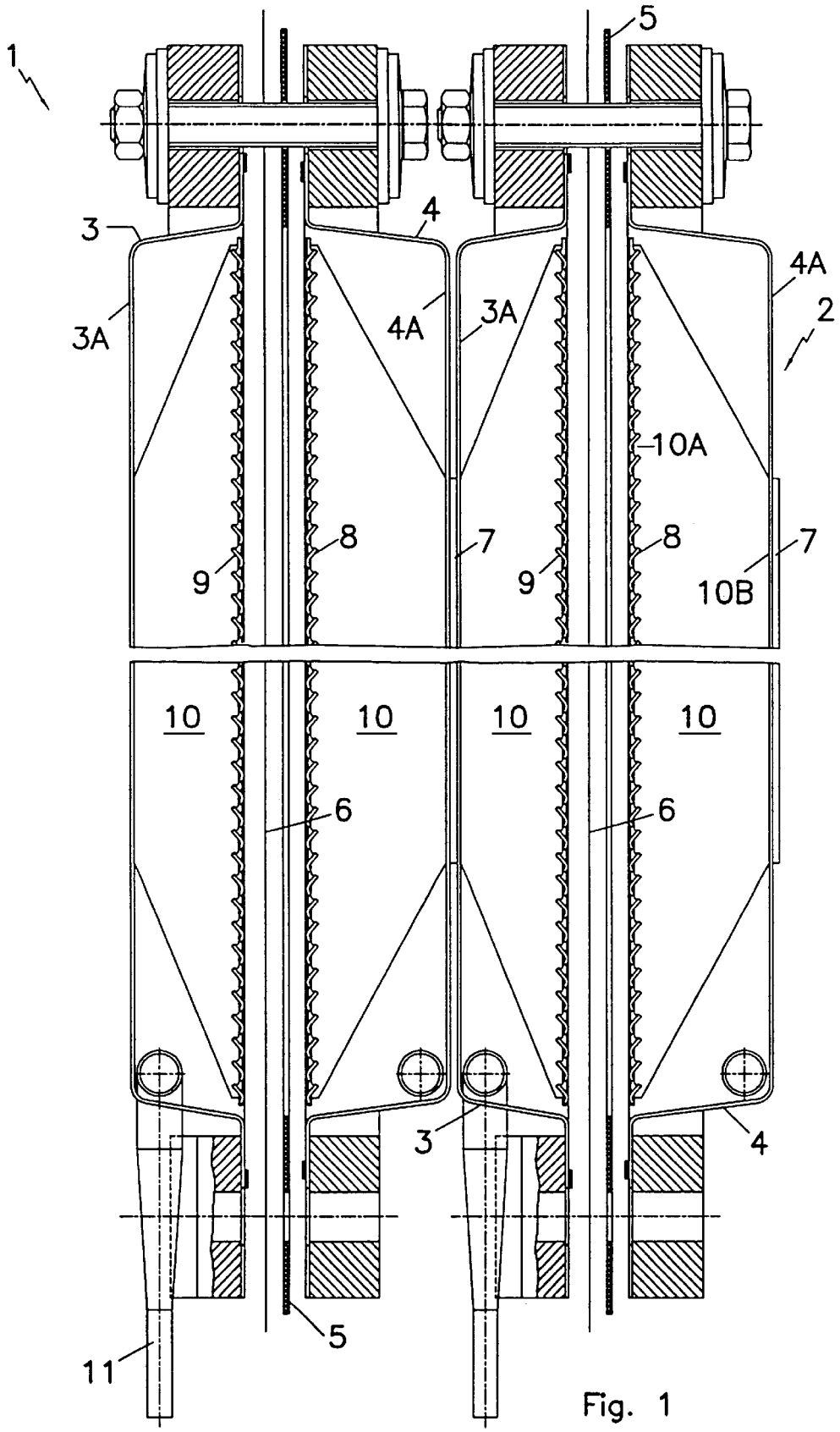

This application is a 371 of PCT/CP97/04402, Aug. 13, 1997.

The invention pertains to an electrolyser for the production of halogen gases from aqueous alkali halogenide solution using several plate-like electrolysis cells arranged side by side in a stack and electrically connected. Each cell is encased in two semi-shells made from electroconductive material with contact strips on the outer side of at least one of the casing's rear walls, the said casings being fitted with feeders for the cell current and the electrolysis feedstock, with devices for discharging the cell current and the electrolysis products and consisting of an anode and a cathode which each have a fundamentally level surface and are separated from one another by a partition, arranged parallel to one another and electrically connected to the rear wall of the respective casing via metal reinforcements.

The invention also pertains to a preferred process for the manufacture of such an electrolyser in which the individual electrolysis cells are manufactured first by joining together the two semi-shells of each respective casing whilst incorporating all requisite devices including the cathode, anode and partition, the latter being fixed using metal reinforcements, and by electrically connecting the anode and the cathode to the casing. The plate-like electrolysis cells produced are electrically connected and arranged side by side in a stack and braced against each other within the stack to ensure sustained contact.

The cell current is fed to the cell stack via the outer cell of the stack from where it is distributed in an essentially vertical direction throughout the cell stack to the centre planes of the plate-like electrolysis cells before being discharged via the outer cell on the other side of the stack. When applied to the centre plane, the cell current achieves an average current density of at least 4 $kA/m^2$.

The applicant knows of such an electrolyser which is mentioned in EP 0 189 535 B1. In this known electrolyser the anode and the cathode are both connected to the rear wall of the respective semi-shells via metal reinforcements arranged in a braced fashion. Each anode and cathode semi-shell is fitted with a contact strip at the rear which is used to ensure electrical contact with the adjacent electrolysis cell which is identical. The current flows along the contact strip through the rear wall into the metal reinforcements. From here it is distributed throughout the anode from the metallic contact points (reinforcement/anode). Once the current has passed through the membrane it is taken by the cathode to enable it to flow along the bracing-type reinforcements into the rear wall on the cathode side and then back into the contact strips before entering the next electrolysis cell. The electroconductive components are connected by spot-welding. The cell current collects at the weld points to create peak current density.

One drawback of the known electrolyser lies in the fact that the current does not flow across the entire surface of the contact strip. This is due to the fact that the current leaving the metallic connection between the bracing-type reinforcement and the rear wall of the cathode is passed into the contact strip at one single point As the current-carrying surface area decreases, the voltage required for the current flow, the so-called contact voltage, increases, and because the specific energy requirement necessary for the production of electrolysis products increases linear to the voltage, production costs also increase.

A further disadvantage of the known electrolyser lies in the fact that for reasons of flexibility, the bracing-type reinforcements connecting the rear wall and the electrodes are not arranged vertically between the rear wall and electrode. This leads to a prolongation of the current paths which also causes the cell voltage to increase. In addition, the current from the bracing-type reinforcement only enters the electrode at one single point leading on the one hand to uneven current distribution and on the other to a renewed increase in the cell voltage. The uneven current distribution on the electrodes also causes the electrolyte to be depleted which results in a decrease in current efficiency and shortens the service life of the membrane.

The purpose of the invention is to create an electrolyser in which the current-carrying surfaces are as large as possible, thereby preventing current from being fed into the electrodes and the contact strips at only one single point thus avoiding uneven current distribution.

In accordance with the invention, the type of electrolyser described in the introduction fulfils this purpose by having metal reinforcements designed in the form of solid plates which are flush with the contact strips and whose side edges run up the entire height of the rear wall and of the anode or cathode.

The electrolyser constructed in accordance with the invention practically prevents uneven current flow through the surfaces as the current is fed into the electrodes and the contact strips across the whole surface and not from one single point The current paths themselves are short as the reinforcing plates can be arranged vertically between the respective rear wall and electrode. The embodiment of the invention described herein ensures that the cell voltage required for the electrolyser is much smaller than that of the known electrolyser.

The cathodes can be made from iron, cobalt, nickel or chrome or from their alloys, and the anodes from titanium, niobium or tantalum, from an alloy of these metals or from a metal-ceramic or oxide-ceramic material. In addition these electrodes are covered with a catalytically active coating, whereby it is preferable for the electrodes to have openings (perforated plate, expanded metal, trellis work or thin sheet metal with louvre-type openings), which allow the gas formed during the electrolytic process to easily enter the space at the rear of the electrolysis cell. This degassing ensures that the electrolyte between the electrodes has as few gas bubbles as possible and is thus able to achieve maximum conductibility.

The partition, or so-called membrane, is an ion-exchanger membrane which is usually made from a copolymer produced from polytetrafluoroethylene or one of its derivatives and a perfluorovinylether sulphonic acid and/or perfluorovinyl carbonic acid. The membrane ensures that the electrolytic products do not mix and its selective permeability with regard to the alkali metal ions permits current flow. Diaphragms can also be used for the partition. A diaphragm is a fine-porous partition which prevents the gases from mixing and which produces an electrolytic connection between the cathode and anode thus permitting current flow.

The solid plates forming the metal reinforcements can be realised as solid surfaces or can be provided with openings or slits.

A further advantage of the electrolyser involves the inlet distributor through which the electrolytes can be fed into the semi-shells to permit optimal electrolyte supply. This inlet distributor is preferably constructed in such a way that each segment of a semi-shell can be provided with fresh electrolyte through at least one opening in the inlet distributor and that the sum of the areas of the openings in the inlet distributor is smaller or equal to the inlet distributors area of cross section.

Provision is also made for the anode and cathode to be integrally connected to the solid plates via an electroconductive twin connection. A preferred embodiment is to integrally link the plane-parallel contact strips to the rear wall and to the solid plate below using an electroconductive, metallic triple connection.

Alternatively, it can also be provided for each respective rear wall to be integrally linked to the solid plates via a metallically conductive twin connection, the contact strips being formed from build-up welds on the rear wall.

The integral linking of the twin or triple connections dispenses with the need for seams between the solid plate and the rear wall on the one hand and between the rear wall and the contact strip on the other, or between the solid plate and the electrode. This means that the cell current flow no longer needs to overcome the electrical surface resistance occurring in the seams.

A further advantage of the integrally linked triple connection has been established. The triple connection causes a considerable increase in the flexural rigidity of the semi-shells' rear walls. Due to the fact that both the prestress prevailing in the stack and the cell current are transferred between the rear walls of the electrolysis cells, (this direct transfer occurring simultaneously via the respective contact strips on the rear walls of the adjacent electrolysis cell), the contact strips must remain level under the influence of the prestress so that the current can flow over as much of the surface as possible between the adjacent contact strips. The higher flexural rigidity of the triple connection decreases the electrical contact resistance between the individual electrolysis cells in the stack.

The anode semi-shells are made from a material which is resistant to halogens and salt solution, whilst the cathode semi-shells are made from a material which is resistant to lye.

One outstanding characteristic of the process for manufacturing the previously described electrolyser according to the invention lies in the fact that the metallic, electroconductive connection between the reinforcements in the form of solid plates and the respective rear wall and anode or cathode is produced by means of a reductive sintering process or welding process.

The reductive sintering process involves an adhesive which mainly comprises an oxidic material, such as NiO, and an organic binder. This adhesive is applied along the solid plate and along the component to which it is to be joined, e.g. the rear wall, and both parts are then pressed together using a screw clamp. Once the organic binder has hardened, the adhesive's oxidic component is hot-sintered in a reductive atmosphere (e.g. H2, CO etc.).

The preferred welding process is the laser beam welding process. The laser beam is polarised perpendicular to the direction of welding to reduce the ratio between the width of the top bead and the junction area.

An optical mirror assembly can be used to form the laser beam in such a way as to enable special beam forming and the generation of two or more focus points, the rate of displacement being selectable.

A further advantage is that the laser beam can be scanned at right angles to the direction of welding at a selectable rate using a scanner drive, preferably a piezoelectric quartz, operating at high-frequency.

Figure 2:
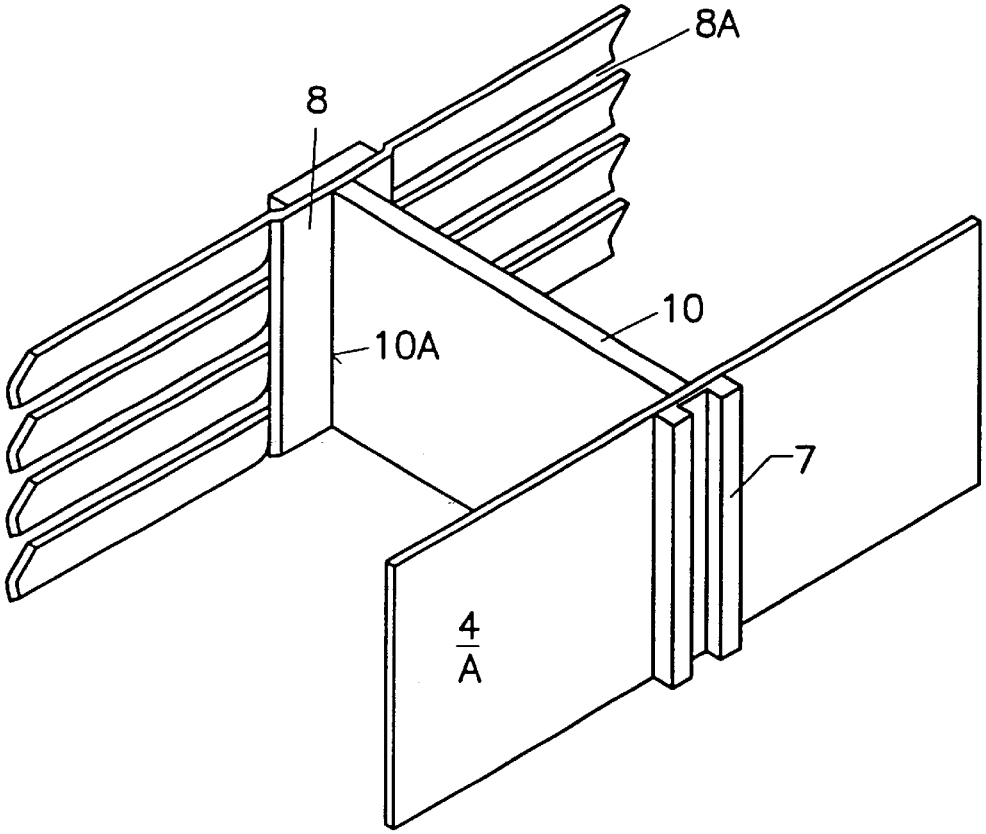

The invention is explained in more detail with the aid of the following diagrams:

FIG. 1 a cross section of two adjacent electrolysis cells in an electrolyser, FIG. 2 an exploded view of a section of FIG. 1

Figure 3D:
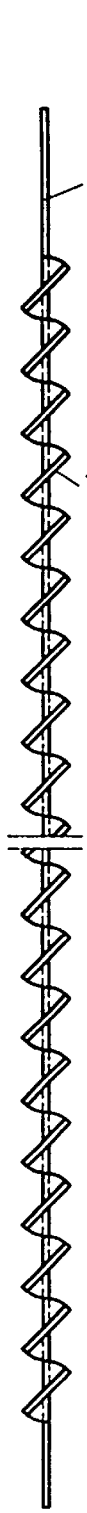
Figure 3C:
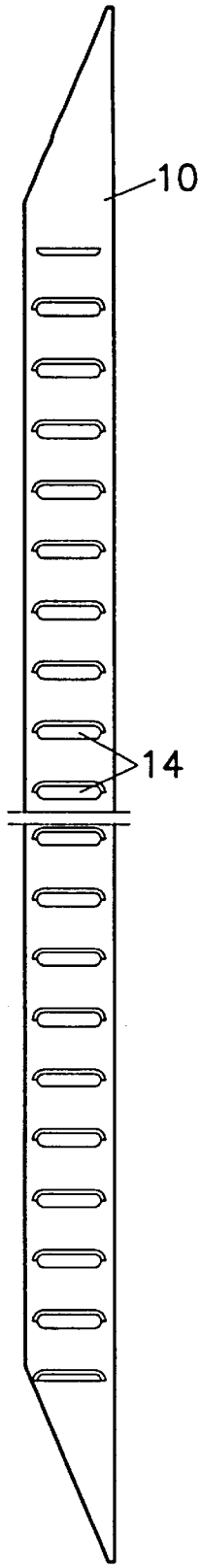
Figure 3B:
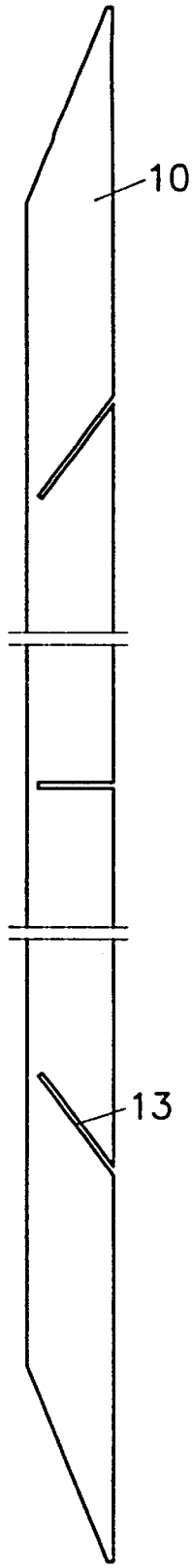
Figure 3A:
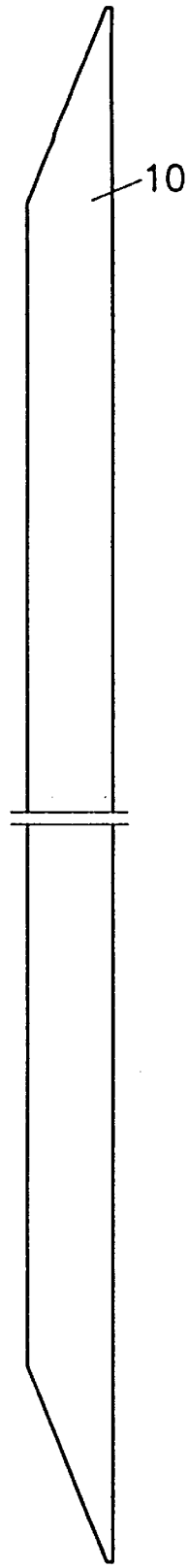
Figure 4A:
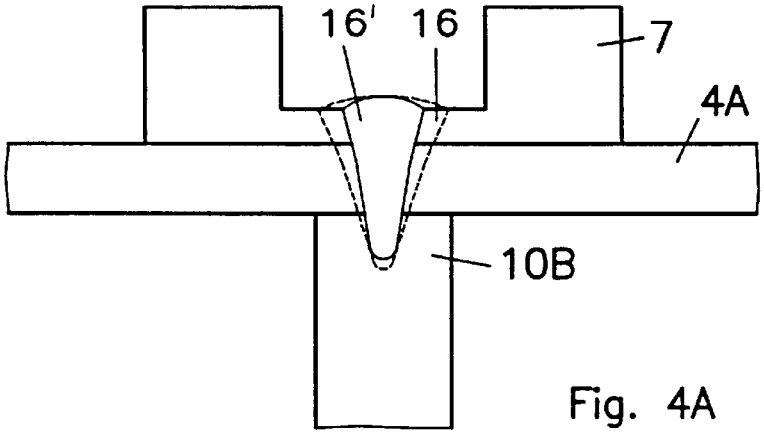
Figure 4B:
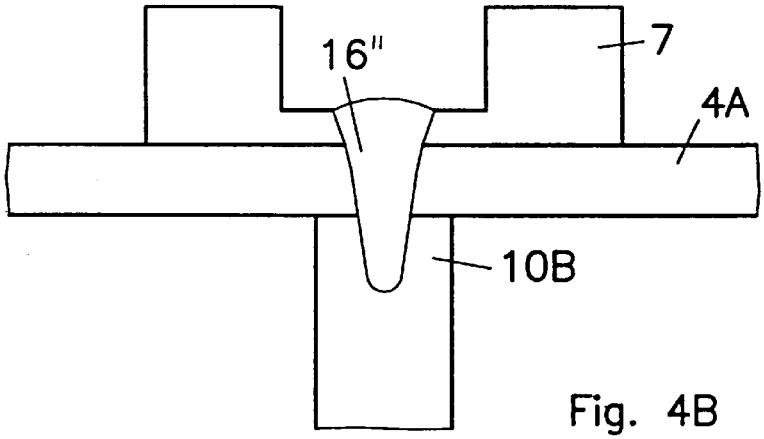
Figure 4C:
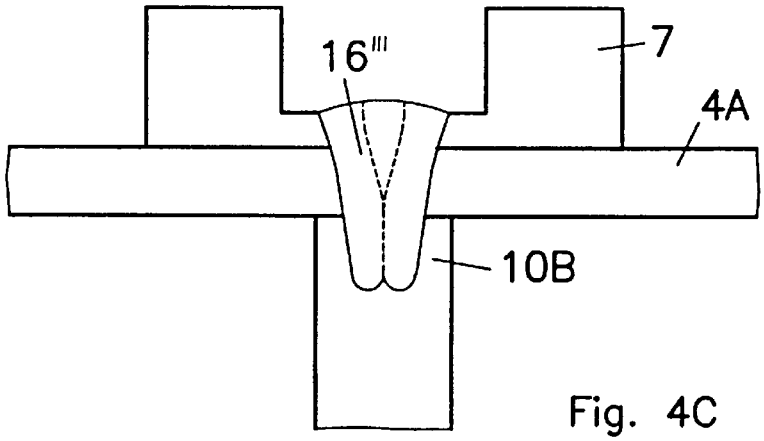

FIGS. 3A to 3D different variants of the reinforcements in the form of solid plates FIGS. 4A to 4C a detailed enlargement of various metallic triple connections between the contact strip, the rear wall of the casing and the solid plate.

The universal electrolyser (1) for the production of halogen gases from aqueous alkali halogenide solution has several adjacent, plate-like electrolysis cells (2) arranged in a stack and electrically connected to each other. In FIG. 1 two such electrolysis cells (2) are shown side by side. Each of these electrolysis cells (2) has a casing consisting of two semi-shells (3, 4) with flange-like collars. A partition (membrane) (6) is fixed between the semi-shells with the aid of a seal (5). Other methods can be used to retain the membrane (6).

Numerous contact strips (7) are arranged in parallel across the entire depth of the rear walls (4A) of each respective electrolysis cell casing (2). These contact strips (7) are attached to the outer side of the rear wall (4A) of the respective casing by welding etc. This is described in more detail below. These contact strips (7) establish the electrical contact to the adjacent electrolysis cell (2), i.e. to the rear wall (3A) which does not have its own contact strip.

Inside each casing (3,4) a level-surfaced anode (8) and a level-surfaced cathode (9) are situated adjacent to the membrane (6), the anode (8) and the cathode (9) each being connected to the reinforcements which are in the form of solid plates (10) and in alignment with the contact strips (7). The solid plates (10) are attached along their entire side edge (10A) to the anode (8) or cathode (9) producing metallic conductivity. In order to enable the electrolysis feedstocks to be fed into the cell and the electrolysis product to be discharged, the solid plates (10) are tapered from the side edges (10A) over their entire width to the adjacent side edge (10B) and at this point are the same height as the contact strips (7). Consequently their side edges (10B) are attached along the entire height of the contact strips to the reverse of the rear walls (3A/4A) facing the contact strips (7).

Each electrolysis cell (2) is fitted with a feeder (11) for the electrolysis product Each electrolysis cell also has a device (not shown) for discharging the electrolysis product.

The electrodes (anode (8) and cathode (9)) are designed in such a way as to allow the electrolysis feedstock and the discharge products to flow or pass freely via slits (8A) or such like as shown in FIG. 2. A frame called a cell frame is used to connect several plate-like electrolysis cells (2) in series. The platelike electrolysis cells are suspended between the two upper beams of the cell frame so that their flat surface is positioned perpendicular to the upper beam axis. The plate-like electrolysis cells (2) have a cantilevered holder on the upper plate edge on both sides so that they can transfer their weight to the upper seal of the upper beam.

The holder is situated in a horizontal position in the direction of the plate level and extends beyond the edge of the flanged collar. The lower edge of the said holder lies on the upper flanged collar of the platelike electrolysis cells suspended in the frame.

The plate-like electrolysis cells (2) are suspended in the cell frame like suspension files. The plate surfaces of the electrolysis cells are in mechanical and electrical contact within the cell frame as if arranged in a stack. Electrolysers with this structural shape are called electrolysers in suspended stack construction.

Using known tensioning devices to join several electrolysis cells (2) side by side in a suspended stack construction, the electrolysis cells (2) are electrically connected to their respective adjacent electrolysis cells in a stack via the contact strips (7). The current then flows from the contact strips (7) through the semi-shells via the solid plates (10) into the anode (8). After passing through the membrane (6) the current is taken by the cathode (9) and flows from here via the solid plates (10) into the other semi-shell, or more precisely into the rear wall of the semi-shell (3A) from where it then passes into the contact strip (7) of the next cell. In this way the cell current intersperses the entire electrolysis stack by being fed into the outer cell and discharged from the outer cell on the other side.

The section of the electrolysis cell represented in FIG. 2 shows a section of the rear wall (4A) of the semi-shell casing (4) to which a U-shaped contact strip (7) is attached. At the rear a solid plate (10) aligned with the contact strip (7) is attached to the casing's rear wall (4A), the solid plate (10) being located at the centre of the U-shaped contact strip (7) of sectional steel. This is described in more detail below with reference to FIGS. 4A and 4C. The other side edge (10A) of the solid plate (10) is attached to the anode (8), the entire surface area of which is connected to the solid plates (10), whilst slits (8A) are provided adjacent to these areas to allow the electrolysis feed and discharge products to pass through. The same applies to the connection between the solid plates (10) and the cathodes (9).

As can be seen in FIGS. 3A to 3D the solid plates (10) can have various designs. The type shown in FIG. 3A represents a solid plate with a solid surface, whereby only the two side edges 10A and 10B vary in length for the above-mentioned reasons.

The model shown in FIG. 3B represents a solid plate (10) with slits (13). FIG. 3D in which the solid plate (10) is viewed from the side according to FIG. 3C, also has splits which are formed by punching slanted holes.

As already shown in FIG. 2, the connections between the electrodes (anode 8 and cathode 9) and the rear walls of the casings (3A/4A) provide a maximum cross-sectional area for the current to flow via the solid plates (10) as the current path is metallically connected along its entire length both to the rear wall of the casing (3A/4A) and to the respective electrode (8/9). In addition the current path is minimised due to the fact that the solid plate (10) represents the vertical connection between the rear wall of the casing (3A/4A) and the electrode (8/9).

The solid plate is connected to the electrode (8/9) and to the rear wall of the casing (3A/4A) without the aid of a seam which would create additional surface resistance for the current flow. For this reason the parts to be connected are joined by a twin or triple metallic connection which is preferably produced using a laser beam welding process, although conventional welding processes, such as resistance welding, are also suitable. The employment of reductive sintering processes is also possible. The weld joint can also be effected spot by spot in order to create as little heat input as possible thus ensuring minimal deformation. It is also possible to effect a weld joint along the entire height of the individual cell, whereby the joint should be continuous as this ensures optimal current distribution and minimal contact resistance thus achieving the lowest possible cell voltage.

FIGS. 4A to 4C show various types of triple connection effected using the laser beam welding process. Each figure also shows a contact strip (7) part of the rear wall of a casing (4A) and the side edge (10B) of a solid plate.

The type shown in FIG. 4A is a laser weld joint with a laser source having a beam value of K=0.5, a radiant power of P=2 kW and a focusing assembly with a focusing value of F=10. The seam (16) produced forms a distinctive bell shape. A typical ratio of 2.5 is produced between the width of the top bead and the junction area.

The welding seam (16') represented by the solid line in FIG. 4A is produced by a laser beam with the same power and focusing value, but with a particularly high beam value of K=0.8. In this case a ratio of 2.0 was achieved between the width of the top bead and the junction area. However, this more favourable ratio with minor semi-shell distortion meant that the junction area between the solid plate (10) and the rear wall (4A) was reduced by almost 25%.

The type shown in FIG. 4B represents a seam type with the same laser source and focusing assembly as in FIG. 4A, but involves a laser beam which is polarised perpendicular to the direction of welding This leads to the seam being spread distinctly as a result of the increased beam focusing, caused by the Brewster effect, which acts on the seam faces. This seam is represented by 16". The ratio between the width of the top bead and the junction area is 1.6. In this case the volume of the seam was approximately the same as that in FIG. 4A, but the junction area increased by almost 25%.

The ratio between the width of the top bead and the junction area is particularly good in the weld joint (16'") shown in FIG. 4C. In this case, the junction area is 50% larger than in the weld joint in FIG. 4A. The seam type (16'") shown here was achieved using special beam forming with the same laser source as in the weld joint in FIG. 4B, whereby an optical mirror assembly forms the laser beam in such a way that two focus points are produced, which are displaced by 0.5 mm. This type of seam can also be achieved by scanning the focusing mirror at high frequency using an amplitude of 0.5 mm, for example.

In the figures where details are not shown, the electrolysis cells (2) have an electrolyte inlet in the lower section. The electrolyte can be fed into the cells at one single point or by means of a so-called inlet distributor. The inlet distributor is located within the element in the form of a pipe with openings. As each semi-shell is segmented by the solid plates 10 which create the connection between the rear walls (3A/4A) and the electrodes (8, 9), an optimal concentration distribution is achieved when both semi-shells (3, 4) are equipped with an inlet distributor, whereby the length of the inlet distributor arranged in the semi-shell corresponds to the width of the semi-shell and each segment is supplied with the respective electrolyte via at least one opening in the inlet distributor. The sum of the area of cross section of the openings in the inlet distributor should be smaller or equal to the internal cross section of the manifold.

As can be seen in FIG. 1, the two semi-shells (3, 4) are bolted in the flanged collar area. The cells are then either suspended or placed in a cell frame which is not shown here. This is done with the aid of holding devices (not shown) located on the flanges. The electrolyser (1) can be made up of one single cell or preferably of a combination of several electrolysis cells (2) arranged side by side in a suspended stack construction. If several individual cells are pressed together in accordance with the suspended stack principle, the individual cells must be aligned in plane-parallel before the tensioning device is dosed otherwise the transfer of current from one cell to the next cannot be effected over all the contact strips (7). In order to be able to align the cells side by side once they have been suspended or placed in the cell frame, it is essential that the elements, which usually weigh approx. 210 kg when empty, can be easily moved. This is achieved by providing the holders i.e. the supporting surfaces located on the cell frame and cell rack (not shown) with an adequate coating. For this purpose the holders located on the elements' flange frame are lined with a synthetic material such as PE, PP, PVC, PFA, FEP, E/TFE, PVDF or PTFE, whilst the supporting surfaces on the cell frame are also coated with one of these synthetic materials. The synthetic material can simply be placed in a groove, stuck on, welded or screwed as long as this synthetic layer is firmly fixed. The fact that two synthetic layers are in contact with one another means that the individual elements located in the frame can be so easily moved that they can be manually aligned side by side without the aid of additional lifting or pushing devices. The movability of the elements within the cell frame enables them to be easily placed along the entire area of the rear wall by closing the tensioning device. This is essential for uniform current distribution. Furthermore this also ensures that the cell is electrically insulated from the cell frame.

what is claimed is:

1. An electrolysis apparatus for producing halogen gases from aqueous alkali halide solution, said apparatus comprising:

a plurality of electrolysis cells in plate form arranged side by side in a stack and electrically connected;

each cell being within a housing comprising two semi-shells made of electrically conductive material with contact strips on the outer side of at least one housing's rear wall, said housing having, feeders for a cell current and an electrolysis feedstock, devices for discharging the cell current and the electrolysis products, said devices further comprising, an anode and cathode each with a substantially level surface and separated from each other by a partition, the anode and cathode arranged paralled to each other and are electrically connected to the rear wall of the respective housing by metal reinforcements, said metal reinforcements being in the form of solid plates which are flush with contact strips and whose side edges run up the entire height of the rear wall and of the anode and cathode.

2. The apparatus of claim 1, wherein said solid plates have no openings or slits on any of the planar surfaces.

3. The apparatus of claim 1, wherein said solid plates are provided with openings or slits on at least one of its planar surfaces.

4. The apparatus of claim 3, wherein said inlet distributor has at least one opening through which said electrolytes may contact each segment of said semi-shells, and the sum of the cross-sectional areas of said openings is equal to or less than, the cross sectional area of the inlet distributor.

5. The apparatus of claim 1, further comprising an inlet distributor through which the electrolytes are fed into said cells.

6. The apparatus of claim 1, wherein the anode or the cathode is connected to the solid plates by an electroconductive twin connection.

7. The apparatus of claim 1, wherein said contact strips are integrally linked to the rear wall and the solid plate below it, by an electroconductive, metallic triple connection.

8. The apparatus of claim 1, wherein each respective rear walls is integrally linked to the solid plates by an electroconductive metallic twin connection.

9. The apparatus of claim 1, wherein the contact strips are built-up welds in the rear wall.

10. The apparatus of claim 1, wherein the anode semi-shells are composed of at least one material that is resistant to halogens and salt solutions.

11. The apparatus of claim 1, wherein the cathode semi-shells are composed of at least one material that is resistant to strongly basic solution.

12. A process for the manufacture of an electrolysis apparatus, comprising the steps of:

assembling individual electrolysis cells by joining together two semi-shells made of electroconductive material, to form a housing, said housing having contact strips on the outer surface of at least one of its rear walls;

supplying said housing with feeders for a cell current and an electrolysis feedstock;

placing within said housing an anode and cathode each having at least one substantially level surface;

placing the anode and cathode in parallel and separating the anode and cathode by a partition;

electrically connecting said anode and cathode to the rear wall of the respective casing by metal reinforcements in the form of solid metal plates that are attached along their entire side edge, to the anode, or cathode, forming a connection between said metal reinforcements and the respective rear wall and anode or cathode by a reductive sintering process or a welding process;

electrically connecting said anode and cathode to the casing, and placing a plurality of assembled electrolysis cells side by side in a stack and braced together so as to sustain contact between the cells.

13. The process of claim 12, wherein said welding process is a laser beam welding process.

14. The process in claim 13, wherein said laser beam is polarized perpendicular to the direction of welding thus lowering the ratio of the top width of the bead to width at the junction area.

15. The process of either claim 12 or claim 13, wherein said laser beam is formed by an optical mirror assembly to produce two focus points of the beam having a selectable rate of displacement.

16. The process of claim 13, wherein the laser beam is scanned at a selectable rate at right angles to the direction of welding using a scanner drive, preferably a piezoelectric quartz operating at high frequency.

* * * * *